US007037418B2

(12) United States Patent
Brandon et al.

(10) Patent No.: US 7,037,418 B2
(45) Date of Patent: May 2, 2006

(54) WEAR AND THERMAL RESISTANT MATERIAL PRODUCED FROM SUPER HARD PARTICLES BOUND IN A MATRIX OF GLASSCERAMIC ELECTROPHORETIC DEPOSITION

(75) Inventors: David Brandon, Haifa (IL); Liudmila Cherniak, Haifa (IL)

(73) Assignee: Cerel (Ceramic Technologies) Ltd., Yokneam Illit (IL)

( * ) Notice: Subject to any disclaimer, the term of this patent is extended or adjusted under 35 U.S.C. 154(b) by 0 days.

(21) Appl. No.: 10/333,726

(22) PCT Filed: Jul. 5, 2001

(86) PCT No.: PCT/IL01/00616

§ 371 (c)(1),
(2), (4) Date: Apr. 1, 2003

(87) PCT Pub. No.: WO02/10484

PCT Pub. Date: Feb. 7, 2002

(65) Prior Publication Data

US 2004/0023035 A1 Feb. 5, 2004

(30) Foreign Application Priority Data

Jul. 27, 2000 (IL) ..... 137548

(51) Int. Cl.
*C08F 2/58* (2006.01)

(52) U.S. Cl. ..... 204/509; 204/450; 204/471; 204/491

(58) Field of Classification Search ..... 501/98.1, 501/98.3; 428/698, 408, 704, 325; 204/450, 204/471, 489, 495, 509; 427/249
See application file for complete search history.

(56) References Cited

U.S. PATENT DOCUMENTS

| | | | | | |
|---|---|---|---|---|---|
| 4,826,791 | A | * | 5/1989 | Mehrotra et al. | 501/98.3 |
| 4,919,974 | A | * | 4/1990 | McCune et al. | 427/249.7 |
| 5,066,423 | A | * | 11/1991 | Kubo et al. | 501/98.3 |
| 5,181,953 | A | | 1/1993 | Nakano et al. | |
| 5,212,123 | A | * | 5/1993 | Schoennahl | 501/98.3 |
| 5,214,009 | A | * | 5/1993 | Komatsu et al. | 501/98.3 |
| 5,238,885 | A | * | 8/1993 | Asayama et al. | 501/98.3 |
| 5,670,252 | A | | 9/1997 | Makowiecki et al. | |
| 5,700,551 | A | | 12/1997 | Kukino et al. | |
| 5,712,030 | A | | 1/1998 | Goto et al. | |
| 5,718,948 | A | | 2/1998 | Ederyd et al. | |
| 5,925,584 | A | * | 7/1999 | Dodds et al. | 501/98.1 |
| 5,925,585 | A | * | 7/1999 | Schoennahl et al. | 501/98.1 |
| 6,059,949 | A | | 5/2000 | Gal-Or et al. | |
| 6,143,207 | A | * | 11/2000 | Yamada et al. | 252/515 |

FOREIGN PATENT DOCUMENTS

| | | |
|---|---|---|
| JP | 02 134237 | 5/1999 |
| WO | WO97/03231 | 1/1997 |

* cited by examiner

*Primary Examiner*—Archene Turner
(74) *Attorney, Agent, or Firm*—Reed Smith LLP

(57) ABSTRACT

A substrate coated with a deposited composite comprising uniformly dispersed hard martial particles in a glassceramic matrix. The deposited bulk composite may comprise uniformly dispersed hard material particles in a glassceramic matrix or hard material particles uniformly dispersed in a glassceramic matrix in a ratio of at least 20% by weight of glassceramic particles and at least 20% by weight of hard material; said mixture having a Vickers hardness of more than 2000 and up to 3000 kg/mm$^2$ and demonstrates an extreme toughness, abrasive and wear resistance, high chemical inertness and a high cutting capability properties.

16 Claims, No Drawings

WEAR AND THERMAL RESISTANT MATERIAL PRODUCED FROM SUPER HARD PARTICLES BOUND IN A MATRIX OF GLASSCERAMIC ELECTROPHORETIC DEPOSITION

This application is a U.S. National Phase filing of PCT Patent Application No. PCT/IL01/00616, filed Jul. 5, 2001, incorporated herein by reference.

FIELD OF THE INVENTION

The invention relates to a wear resistant composite, comprising a homogeneously distributed hard material particles in particular, cubic boron nitride or diamond, in a glassceramic matrix, in the form of either a substrate-coated or a bulk material, having superior heat, toughness and abrasive resistance, chemical inertness and high cutting capability. The invention further relates to a process for preparing articles containing same composite.

BACKGROUND OF THE INVENTION

In general, a diamond or cubic boron nitride (CBN) sintered body is widely used for a cutting tool. Multilayered coated cemented carbide bodies comprising diamond or cubic boron nitride are known, for example:

U.S. Pat. No. 5,718,948 discloses a cemented carbide body, provided with a diamond or cubic boron nitride (CBN) coating, applied by chemical vapor deposition (CVD) or physical vapor deposition (PVD) technique, to be used in tools for drilling of rock and mineral. The cemented carbide body having a substrate containing at least one metal carbide, a binder metal and a coating layer (or layers) consisting of diamond or CBN.

U.S. Pat. No. 5,712,030 relates to a hard composite sintered body comprising CBN or diamond and cemented carbide. More specifically, the composite comprising an intermediate layer consisting of a material selected from cemented carbide, ferrous metals and high melting point metal, and first and second layers (above and below) containing CBN or diamond.

U.S. Pat. No. 5,700,551 demonstrates an ultrafine particle-layered film, wherein said film has more than two layers made of ultrafine particles of a different compound consisting mainly of carbide, nitride, carbonitride, or oxide of at least one element selected from a group con g of IVa group elements, Va group elements, VIa group elements, Al Si and B. The ultrafine-layered film is applicable to cutting tools whose substrate is made of CBN sintered body, diamond sintered body, silicon nitride sintered body, aluminum oxide-titanium nitride sintered body and cemented carbide.

U.S. Pat. No. 5,670,252 teaches hard coatings that are a multilayer structure consisting of alternating layers of boron and boron carbide, and alternating layers of boron nitride and boron carbide.

U.S. Pat. No. 5,181,953 demonstrates a surface-coated cemented carbide suitable for use as cutting tools and wear resisting tools. This coated cemented carbide alloy is composed of a cemented carbide substrate consisting of a hard phase of at least one member selected carbides, nitrides and carbonitrides of group IVb, Vb and VIb metals and a binder phase consisting of at least one member selected from the iron group metals, and a monolayer or multilayer, provided on the substrate consisting of at least one member selected from carbides, nitrides, oxides and borides of group IVb, Vb and VIb metals, solid solution thereof and aluminum oxide.

None of the above described patents teaches how to obtain a homogenously dispersed particles in the wear resistant deposited composites. Furthermore, CVD and PVD procedures provide deposited layers of only several microns thickness while the duration of such procedures may take hours. Consequently, there is a need to provide a short-time process for producing a uniformly dispersed wear resistant deposited composite, having a wide range of layer thickness, or bulk body.

SUMMARY OF THE INVENTION

It is an object of the present invention to impart to a substrate extreme wear resistance and high cutting capability by means of coating same substrate with a composite comprising uniformly dispersed hard materials in particular, cubic boron nitride or diamond in a glassceramic matrix It is a further object of present invention to provide a new deposited composite comprising uniformly dispersed hard materials, in particular boron nitride and diamond, in a glassceramic matrix, demonstrating an extreme toughness, abrasive and wear resistance, high chemical inertness, high cutting capability and having Vickers hardness of more than 2000 and up to 3000 kg/mm$^2$.

It is yet another object of the present invention to provide an electrophoretic deposition (EPD) process for coating a substrate with said deposited composite. A major embodiment of the present invention is the use of such electrophoretic deposition method for obtaining deposited composite, consisting of uniformly dispersed hard particles in glassceramic, having a wide range of thickness, (from a few microns to millimeters), in a very short-time (from a few seconds to minutes). Said EPD method provides a deposited composite with green density of about 60% of theoretical value, which may increase to over 90%, following the sintering step. Consequently, it is an additional object of present invention to provide a tool for cutting hard materials, wherein same tool is coated with a composite consisting of a hard material uniformly dispersed in a glassceramic matrix, or as a bulk composite, consisting of a hard material uniformly dispersed in a glassceramic matrix The process according to present invention for production of deposited coated composite, comprising uniformly dispersed hard material in a glassceramic matrix, consists of two principal steps:

1. Electrophoretic deposition of a homogenous suspension containing a hard material such as, cubic boron nitride, diamond, titanium carbide, titanium nitride, titanium carbonitride, aluminum nitride, and silicon nitride particles and;

a) Glassceramic particles such as, SiAlON, TiAlON or mixture thereof;

b) Particles of titanium oxide, titanium nitride, titanium carbide, silicon nitride, silicon carbide, silicon oxide, aluminum nitride, aluminum oxide, and yittrium oxide, which are further converted to glassceramic materials upon sintering.

Materials useful for the glassceramic matrix may be glassceramic commercial materials or material converting into a glassceramic matrix (batch components), following a sintering process (for example, titanium oxide, titanium nitride, titanium carbide, silicon nitride, silicon carbide, silicon oxide, aluminum nitride, aluminum oxide, and yittrium oxide). Hard materials (for example, titanium carbide, titanium nitride, aluminum nitride, silicon nitride and others) may also be used as batch components for providing glassceramic dispersed particles upon sintering.

2. Sintering of the deposit, thus obtained.

According to the present invention there is provided a wear resistant part as a bulk composite material or as a coated metallic alloy or cermet substrate (a composite material or article comprised of a ceramic and a metal or metal alloy, interdistributed in any or various geometrical forms but intimately bonded together, ASTM 1145-94a). A preferred composite material, according to present invention, obtained by the method of electrophoretic deposition (EPD), consisting of glassceramic bonded hard material, selected from the group comprising diamond, nitrides such as cubic boron nitride (CBN), titanium nitride, aluminum nitride, silicon nitride, carbides such as titanium carbide, silicon carbide and carbonitrides such as titanium carbonitride particles.

The method of electrophoretic deposition of CBN or other hard particles as a green body (coating or bulk) includes the steps of:

Forming a homogenous suspension comprising a mixture of hard material and glassceramic particles and/or materials convertible into glassceramic particles, in a polar solvent; the hard material particles constituting about 20–80% by weight of the mixture and the glassceramic materials and/or materials convertible into glassceramic particles constituting about the remaining 80–20% by weight of the mixture (i.e. the weight of the hard particles+the weight of the glassceramic particles=100% of the weight of the mixture).

(II) Passing a direct electrical current through the suspension, in which deposition and counter electrodes are immersed.

The preferred polar organic solvent is ethanol. Aqueous suspensions are not suitable for the present application because they are subject to electrolysis, leading to the formation of hydrogen bubbles at the cathode and consequent decrease in the density and local uniformity of a deposited coating. In the deposition of the composite of present invention on a substrate applying EPD process, the particles may be positively charged, in which case they are deposited on the cathode or negatively charged, in which case they are deposited on the anode. The electrode, on which the charged particles are deposited, is referred herein as the "deposition electrode".

To impose the needed surface charge on the particles and to de-agglomerate them, the suspension is subjected to ultrasound treatment at 20 kHz and a power level of up to about 550 watts, for between about 2 minutes and about 15 minutes.

Additives such as pH and conductivity adjustment agents, dispersants and binders may be added to the suspension. The preferred pH and conductivity adjustment agents are phosphate ester, acetic acid and hydrochloric acid. It was found that they allow control of pH and conductivity of suspensions to provide a desired range for electrophoretic particles deposition. The preferred dispersant is acetylacetone, which has been found to allow the deposition of a dense coating with a smooth uniform surface. The preferred binders are menhaden oil (fish oil), polyvinyl butyral, nitrocellulose, ethylcellulose and shellac. The binders were found to strengthen the deposited green coating. The selected electrode materials should be conductive, inert under process conditions and inhibit the evolution of hydrogen gas. If bulk composite material is produced the deposition electrode may be either consumable or reusable. The consumable deposition electrode is destroyed during the sintering process, so that the green body need not be removed from the electrode before sintering. The preferred materials for a consumable electrode are carbon, graphite and conducting polymers. The preferred materials for a reusable deposition electrode are stainless steel, nickel, aluminum, copper, tungsten carbide, conducting oxides and noble metals such as platinum, palladium, silver, gold and their alloys. In the case of coating deposition the coated substrate is a deposition electrode. The preferable materials for the counter electrode are conducting oxides or noble metals.

The cathode and anod are immersed into the suspension, and a direct electrical current is passed between the electrodes. Deposition can be carried out either at a constant current (the preferred range of current densities is between about 0.05 mA/cm$^2$ and about 5 mA/cm2) or at a constant voltage (the preferred voltage range is between about 30 volts and about 400 volts). Typical deposition times are from a few seconds to a few minutes. The deposition conditions depend on type and concentration of dispersed materials, type of solvent, type and concentration of additives, etc. and on required deposit properties, such as thickness, green density, uniformity, etc. Removal of the bulk green body from the deposition electrode is facilitated by polishing the electrode surface or by coating of its surface with a fibrous material such as lens paper before deposition On the other hand, etching or sandblasting of the substrate surface before deposition provides high adhesion of a deposited coating to the substrate. Following the deposition, the green body or coated substrate is dried in a dessicator.

The subsequent sintering of the obtained materials is carried out in a furnace. The sintering regime depends on the deposit and substrate materials.

The following examples are provided merely to illustrate the invention and are not intended to limit the scope of the invention in any manner.

EXAMPLE 1

A suspension was prepared by dispersing 50 gr of cubic boron nitride powder (particle size 1–3 microns), 5 gr of TiCN, 5 gr of Y2O3, 30 gr Al2O3 in 100 ml of ethanol. Phosphate ester was added to the dispersion to adjust the pH to about 4 and the conductivity of the dispersion to about 2–3 μS/cm. The dispersion was subjected to ultrasonication for about 5 minutes. About 0.1% by volume of binder (polyvinyl butyral) was added to the dispersion. It was then transferred to an electrophoretic cell.

The cathode was a tungsten carbide substrate. The electrophoretic cell was provided with a palladium cylinder anode about 60 mm in diameter. The cathode was placed in the electrophoretic cell at the center of the anode, and a direct electrical current having a constant current density of about 0.1 mA/cm2 was passed between the electrodes for about 60 seconds.

The coated substrate was removed from the cell, and dried in a dessicator for a few minutes. The process provided for obtaining a uniform coating with a thickness of about 100 microns. The green coating had a green density of about 50% of theoretical density. The subsequent sintering was carried out during 2 hours in a nitrogen atmosphere.

EXAMPLE 2

A glassceramic bonding matrix based on alpha or beta SiAlON or a mixture thereof and TiAlON, besides of good Mechanical and thermal properties, has high wetting ability of cubic boron nitride and diamond particles, chemical inertness to hard material particles, at high temperature.

A suspension was prepared by dispersing 60 gr of cubic boron nitride powder (particle size 1–3 microns), 15 gr of $Si_3N_4$, 5 gr of $Y_2O_3$, 20 gr $Al_2O_3$ and 10 gr AlN in 1000 ml of ethanol. Phosphate ester was added to the suspension to adjust the pH to about 4 and conductivity of the suspension to about 2–3 μS/cm. The same volume of acetylacetone as an additive dispersant was added to the dispersion. The suspension was subjected to ultrasonication for about 10 minutes. About 0.2% by volume of binder (ethylcellulose) was added to the dispersion, which was then transferred to an electrophoretic cell.

The cathode was a tungsten carbide substrate. The electrophoretic cell was provided with a palladium cylinder anode about 70 mm in diameter. The cathode was placed in the electrophoretic cell at the center of the anode, and a direct electrical current having a constant current density of about 0.2 mA/cm2 was passed between the electrodes for about 120 seconds.

The coated substrate was removed from the cell, and dried in a dessicator for a few minutes. The process provided for obtaining a uniform coating with a thickness of about 150 microns. The green coating had a green density of about 60% of theoretical. The subsequent sintering was carried out in an electric kiln at 1500° C. during 2 hours in a nitrogen atmosphere.

EXAMPLE 3

To obtain bulk material a suspension was prepared by dispersing 100 gr of cubic boron nitride powder (particle size 1–3 microns) and 100 gr of SiAlON 404 powder ("Predmat Inc.", average particle size 5 micron) in 1000 ml of ethanol.

Phosphate ester was added to the suspension to adjust the pH to about 4–5 and conductivity of the dispersion to about 2–3 μS/cm. The dispersion was subjected to ultrasonication for about 5 minutes. About 0.1% by volume of binder polyvinyl butyral was added to the dispersion, which was then transferred to an electrophoretic cell.

The cathode was a palladium substrate covered with lens paper. The electrophoretic cell was provided with a palladium cylinder anode about 70 mm in diameter. The cathode was placed in the electrophoretic cell at the center of the anode, and a direct electrical current having a constant current density of about 0.5 mA/cm2 was passed between the electrodes for about 300 seconds.

The coated substrate was removed from the cell, and the bulk deposit with thickness of up to 2–3 mm) was removed from the substrate and dried in a dessicator and stored there before sintering. The process provided for obtaining a uniform product with a thickness of about 1.5 millimeter. The green body had a green density of about 60% of theoretical.

The invention claimed is:

1. An electrophoretic process for producing a deposited composite material consisting essentially of uniformly dispersed hard material particles in a glassceramic matrix, comprising the steps of:

(a) providing a suspension containing 5–50% by weight (solid in solvent) of a mixture consisting of fine powders of hard materials, glass ceramic materials and/or materials convertible into glassceramic material, in a liquid consisting mainly of an organic solvent, said hard material particles constituting 20–80% by weight of said mixture and said glassceramic materials and/or materials convertible into glassceramic particles constituting the remaining part by weight of said mixture;

(b) immersing in said suspension a substrate acting as a deposition electrode;

(c) applying a direct current to said deposition electrode to cause electrophoretic deposition of the fine powder of the suspension thereon, wherein powders of said glassceramic matrix and/or materials convertible into same glassceramic matrix are deposited, so that said hard materials are distributed uniformly in the deposit; and (d) sintering the deposited composite obtained in step (c) at a temperature at which SiAlON and TiAlON are formed from the corresponding nitrides and oxides and at which SiAlON and TiAlON form a glassceramic matrix.

2. An electrophoretic process according to claim 1, for coating a substrate with a deposited composite comprising of uniformly dispersed hard material particles in a glassceramic matrix.

3. An electrophoretic process according to claim 1, for producing a bulk deposited composite, comprising of uniformly dispersed hard material particles in a glassceramic matrix.

4. An electrophoretic process according to claim 1, wherein said fine hard material powder is selected from the group consisting of diamond, cubic boron nitride (CBN), titanium nitride, aluminum nitride, silicon nitride, titanium carbide, silicon carbide, and titanium carbonitride particles.

5. An electrophoretic process according to claim 4, wherein powder particle size is less than 10 microns.

6. An electrophoretic process according to claim 1, wherein said glassceramic materials for providing a glassceramic matrix are selected from the group consisting of alpha SiAlON, beta SiAlON, TiAlON, and mixtures of two or more thereof.

7. An electrophoretic process according to claim 1, wherein said materials convertible into SiAlON and TiAlON glassceramic matrix during the sintering process are selected from the group consisting of titanium oxide, titanium nitride, titanium carbide, titanium carbonitride, silicon nitride, silicon carbide, silicon oxide, aluminum nitride, aluminum oxide, and yittrium oxide.

8. An electrophoretic process according to claim 7, wherein the materials convertible into SiAlON and TiAlON glassceramic matrix are selected from the group consisting of $Al_2O_3$, $TiO_2$, $SiO_2$, AlN, $Si_3N_4$, SiC, TiCN, TiN, and TiC.

9. An electrophoretic process according to claim 1, wherein the deposition electrode is either a cathode or an anode.

10. An electrophoretic process according to claim 1, wherein at least two additives are used together in the suspension, acting as pH and conductivity adjustment agents, charging agents, dispersants and/or binders.

11. An electrophoretic process according to claim 10, wherein the additives used for pH and conductivity adjustment are selected from the group consisting of phosphate esters, acetic acid, and hydrochloric acid.

12. An electrophoretic process according to claim 10, wherein the charging agents and dispersant are selected from the group consisting of acetylacetone, aluminum chloride, nickel chloride, and cobalt chloride.

13. An electrophoretic process according to claim 10, wherein the binder is selected from the group consisting of menhaden oil (fish oil), polyvinylbutyral, nitrocellulose, ethylcellulose, and shellac.

14. An electrophoretic process according to claim 1, wherein current density of said direct electrical current is between about 0.05 mA/cm2 and about 5 mA/cm2; deposition times are sufficient to obtain a deposit coating with thickness of about 50 microns up to a few millimeters; and the deposited composite has a green density of at least 50% of theoretical.

15. An electrophoretic process according to claim 1, further comprising the step of removing said deposited composite from said substrate.

16. An electrophoretic process according to claim 1, wherein the deposition times are between one minute and five minutes.

* * * * *